US008057247B2

(12) United States Patent
Katano

(10) Patent No.: US 8,057,247 B2
(45) Date of Patent: Nov. 15, 2011

(54) CONTACT AND ELECTRICAL CONNECTOR

(75) Inventor: Tetsuya Katano, Kanagawa (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 12/913,876

(22) Filed: Oct. 28, 2010

(65) Prior Publication Data

US 2011/0039456 A1 Feb. 17, 2011

Related U.S. Application Data

(63) Continuation of application No. PCT/JP2010/056664, filed on Apr. 14, 2010.

(30) Foreign Application Priority Data

May 14, 2009 (JP) ..... 2009-117958

(51) Int. Cl.
*H01R 13/64* (2006.01)

(52) U.S. Cl. ..... 439/251

(58) Field of Classification Search ..... 439/246, 439/249, 251, 857; 200/246
See application file for complete search history.

(56) References Cited

U.S. PATENT DOCUMENTS

| | | | | |
|---|---|---|---|---|
| 6,551,143 | B2 | 4/2003 | Tanaka et al. | |
| 7,140,895 | B2 * | 11/2006 | Tuin et al. | 439/246 |
| 7,556,515 | B2 | 7/2009 | Kato et al. | |
| 7,575,487 | B2 | 8/2009 | Yodogawa | |
| 7,581,972 | B2 * | 9/2009 | Daamen | 439/249 |
| 7,740,511 | B2 | 6/2010 | Katano | |

FOREIGN PATENT DOCUMENTS

JP 2003-323931 11/2003

* cited by examiner

*Primary Examiner* — Phuong Dinh
(74) *Attorney, Agent, or Firm* — Barley Snyder

(57) ABSTRACT

A contact is attached to a connector housing thereby contacting a mating connector. The contact includes a contact section, a pair of tabs, and a pair of springs. The contact section is includes a pair of arms that extend frontward while facing each other and a support bearing the pair of arms. The pair of tabs are positioned on left and right sides of contact with the contact section positioned between. The pair of springs bend from both left and right sides of the support respectively, and frontward further than the tabs. The pair of springs also extend backward and then connect to the tabs. The pair of springs support the contact section and allow the contact section to move in the left-right direction by elastic deformation.

20 Claims, 10 Drawing Sheets

CONTACT AND ELECTRICAL CONNECTOR

CROSS-REFERENCE TO RELATED APPLICATIONS

This application is a continuation of PCT International Application No. PCT/JP2010/056664, filed Apr. 14, 2010, which claims priority under 35 U.S.C. §119 to Japanese Patent Application No. JP 2009-117958, filed May 14, 2009.

FIELD OF THE INVENTION

The invention relates to an electrical connector and in particular to an electrical connector having a contact to make contact with and electrically couple with a mating contact.

BACKGROUND

A known example of such a contact is disclosed in Japanese Patent Application Laid-open Publication No. 2006-19296. A contact section of the disclosed type of contact includes a spring for pinching a mating contact to maintain a contacting state even when the mating contact moves relative to the contact.

A known contact 800, shown in FIG. 9, includes a U-shaped contact section 801, a pair of leg sections 802 to be connected to a circuit board, a pair of free ends 803 provided in the contact section 801, and a pair of flat springs 804 that respectively extend from the pair of free ends 803 and each bend 180 degrees at two points on the way to the corresponding leg section 802. The leg sections 802 are connected to the circuit board (not shown) by solder, and the U-shaped contact section 801 pinches a mating contact to establish electrical connection therewith (not shown).

In the contact 800, the two free ends 803, positioned on both sides of the mating contact, are directly linked to the separate springs 804 respectively. For this reason, when vibration or shock is applied to the mating contact, space is momentarily formed between the two free ends 803 and the mating contact, which may break electrical connection.

Thus, there is proposed a contact having such a structure that a pair of arms are supported by a support, and this support is supported by a pair of springs in a displaceable manner (see, for example, Japanese Patent Laid-Open No. 2008-98052.)

FIGS. 10A and 10B are perspective views of another known contact that is different from that in FIG. 9. The contact 900, shown in FIGS. 10A and 10B, includes a pair of arms 902 and 903 that extend forward while facing each other, a plate-shaped support 904 that supports the arms 902 and 903, a pair of springs 905 and 906 that bend at and extend from both sides of the support in a left-right direction that is a direction in which the arms 902 and 903 face each other, and tabs 908 and 909 provided at the respective tips of the springs 905 and 906. The contact 900 is fixed to a cover (not shown) of the connector when the tabs 908 and 909 are press-fit into the cover. The arms 902 and 903 that hold the mating contact (not shown) move together with the support 904 by following the mating contact.

The tabs 908 and 909 in the contact 900 shown in FIGS. 10A and 10B are disposed frontward like the tips of the arms 902 and 903, extending from the support 904. Besides, the tabs 908 and 909 are aligned with the tips of the arms 902 and 903 in the left-right direction in which the arms 902 and 903 facing each other pinch the mating contact. In other words, the tabs 908 and 909 are disposed on both sides between which the tips of the arms 902 and 903 are interposed. For this reason, a range in which the tips of the arms 902 and 903 may move is limited to a range between the tabs 908 and 909 (to be exact, a range in the cover where the contact 900 is disposed, the range being narrower by the thickness of press-fit parts of the cover into which the tabs 908 and 909 are press-fit). If an attempt is made to secure the range in which the tips of the arms 902 and 903 move by following the mating connect, while avoiding interference with the tabs 908 and 909, it is necessary to dispose the tabs 908 and 909 with a wider space in between. Thus, in a case in which plural contacts are aligned and disposed, it is impossible to place them by narrowing the pitch between the contacts.

SUMMARY

The invention addresses the foregoing problems, and provides a contact and an electrical connector in which electrical connection is hard to break and a range in which arms move is extended.

The contact is attached to the electrical connector housing thereby contacting a mating connector. The contact includes a contact section, a pair of tabs, and a pair of springs. The contact section is includes a pair of arms that extend frontward while facing each other and a support bearing the pair of arms. The pair of tabs are positioned on left and right sides of contact with the contact section positioned between. The pair of springs bend from both left and right sides of the support respectively, and frontward further than the tabs. The pair of springs also extend backward and then connect to the tabs. The pair of springs support the contact section and allow the contact section to move in the left-right direction by elastic deformation.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Figure 1A:
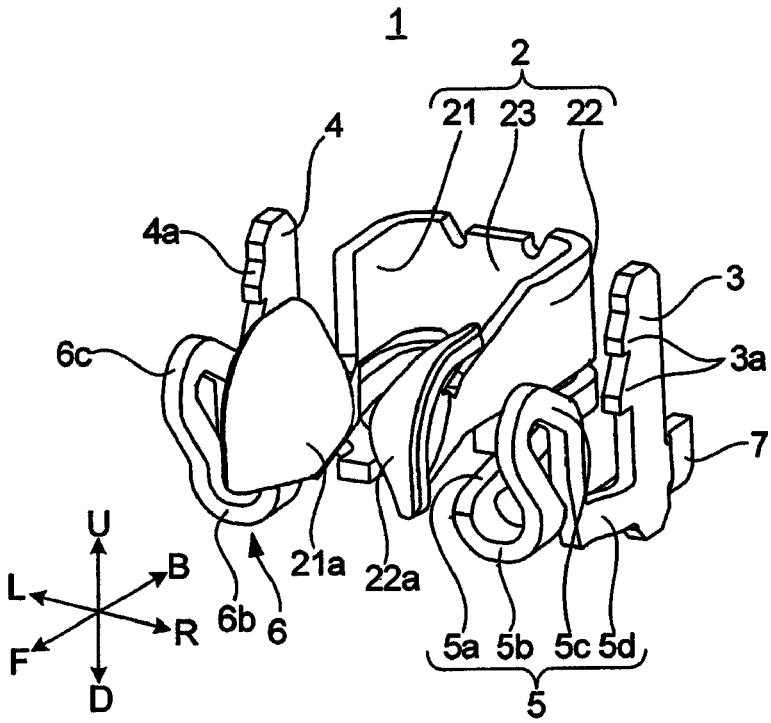
FIG. 1A is a perspective view of a contact according to the invention.

Embodiments of the contact and the electrical connector of the present invention will be described below with reference to the drawings.

FIG. 1A through FIG. 2E are external views of a contact according to the invention. The contact 1 is, for example, a component for being connected by soldering to a conductor pattern on a printed circuit board (not shown), and for electrically contacting and thereby being coupled to a mating contact that will be described later. The contact 1 includes a contact section 2, a pair of tabs 3 and 4, a pair of springs 5 and 6, and a pair of substrate connectors 7 and 8. The contact 1 is produced by stamping and forming sheet metal. The contact section 2, the tabs 3 and 4, the springs 5 and 6, and the substrate connectors 7 and 8 are formed integrally as one piece.

The contact section 2 includes a pair of arms 21 and 22 extending while facing each other, and a flat support 23 being connected to and thereby supporting the arms. The arms 21 and 22 extend after bending 90 degrees from both sides in a left-right direction LR in which the arms 21 and 22 of the support 23 face each other. Here, in the contact 1, a direction in which the arms 21 and 22 extend from the support 23 is referred to as a frontward direction F, and a direction opposite to the frontward direction F is referred to as a backward direction B. Further, directions in which the arms 21 and 22 face toward each other are referred to as a right direction R and a left direction L, respectively, and the left-right direction LR in which the arms 21 and 22 face each other is also referred to as a facing direction LR. Furthermore, a direction in which the tabs 3 and 4 extend is referred to as an upward direction U, and a direction opposite to the upward direction U is referred to as a downward direction D.

The pair of arms 21 and 22 extend frontward after bending at both sides in the left-right direction LR of the support 23, and the arms 21 and 22 are provided with spherical connection pads 21*a* and 22*a* at the respective tips. The arms 21 and 22 are disposed so that a gap between the connection pads 21*a* and 22*a* is smaller than the thickness of a mating contact 331 (see FIG. 5). When the mating contact shaped like a plate is inserted between the arms 21 and 22, the arms 21 and 22 elastically deform so that the gap between the connection pads 21*a* and 22*a* widens and receives the mating contact, and at the same time, the arms 21 and 22 hold the mating contact with the connection pads 21*a* and 22*a* by applying pressure from both sides in the left-right direction LR. The connection pads 21*a* and 22*a* have the respective curved surfaces spherically bulging toward each other and thus, the mating contact interposed between the connection pads 21*a* and 22*a* is prevented from being damage. Further, the arms 21 and 22 extend in the frontward direction F after bending at both sides in the left-right direction LR of the support 23 and thus, the arms 21 and 22 may receive the mating contact in the backward direction B, i.e. toward a deeper side, up to a position of the support 23.

The springs 5 and 6 link the tabs 3 and 4 to the support 23. Specifically, the springs 5 and 6 bend at both sides in the left-right direction LR from the support 23, respectively, and then extend in the frontward direction F further than the tabs 3 and 4, and subsequently, the springs 5 and 6 extend in the backward direction B and are connected to the tabs 3 and 4, respectively. To be specific, the springs 5 and 6 include: first extending sections 5*a* and 6*a* that extend from the support 23 in the frontward direction F; first U-shaped sections 5*b* and 6*b* that are bent outward in the left-right direction LR to be away from the contact section 2; second U-shaped sections 5*c* and 6*c* that extend in the upward direction U from the first U-shaped sections 5*b* and 6*b* and then bend to the backward direction B and further extend in the downward direction D; and link sections 5*d* and 6*d* that link the respective lower ends of the second U-shaped sections 5*c* and 6*c* and the respective lower ends of the tabs 3 and 4, respectively. The arms 21 and 22 bend at both ends in the left-right direction LR of the support 23 at positions higher than the springs 5 and 6 in the upward direction U, and then extend in the frontward direction F.

The tabs 3 and 4 extend from the ends of the link sections 5*d* and 6*d* in the upward direction U. In the tabs 3 and 4, barbs 3*a* and 4*a* are formed to prevent removal after the press-fitting. When the tabs 3 and 4 are press-fit into a cover of an electrical connector that will be described later, the contact 1 is fixed to the cover. When the tabs 3 and 4 are press-fit into the cover, the contact section 2 is movably supported in the left-right direction LR by the springs 5 and 6 that are connected to these tabs 3 and 4 and elastically deform. As clearly shown in FIG. 2A, the link sections 5*d* and 6*d* are slightly bent outward in the left-right direction LR, so that the tabs 3 and 4 are disposed at positions outwardly away from each other in the left-right direction LR. As a result, the thickness of each fixing groove section 223 (see FIG. 6) of the cover that will be described later is adjusted.

Since each of the springs 5, 6 has the first U-shaped section 5*b*, 6*b* and the second U-shaped section 5*c*, 6*c*, it is possible to ensure the sufficient lengths of the springs 5, 6 while disposing the tabs 3, 4 further rearward than the tips of the arms 21, 22, and sufficiently ensure a range in which the springs 5, 6 elastically deform.

The substrate connectors 7 and 8 are components of the contact to be connected to the circuit board (not shown) and the like by soldering, and extend from the lower ends of the tabs 3 and 4 in the backward direction B. The substrate connectors 7 and 8 have the respective tips bending 90 degrees.

In the contact 1, because the springs 5 and 6 elastically deform, the contact section 2 is supported in the left-right direction LR to be movable together with the arms 21 and 22. Therefore, when the mating contact is moved in the left-right direction LR by external force in a state in which the mating contact is held by the arms 21 and 22 of the contact 1, the springs 5 and 6 elastically deform and both of the arms 21 and 22 move together with the support 23 by following the movement of the mating contact.

Figure 9:
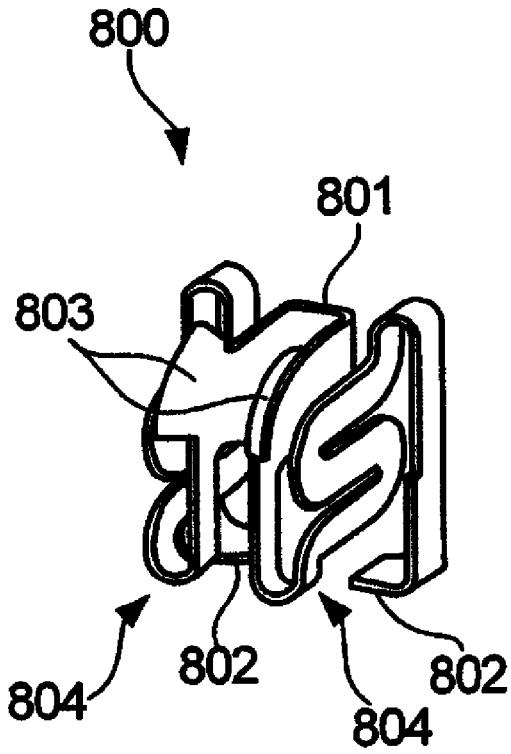
FIG. 9 RELATED ART
FIG. 9 is a perspective view of a known contact.

In contradistinction, in the known contact 800 in FIG. 9, the two free ends 803, positioned on both sides of the mating contact, are directly connected to the separate springs 804, respectively. For this reason, when vibration or shock is applied to the mating contact, one of the two springs 804 may not be able to follow the other and thereby a gap is momentarily formed between the two free ends 803 and the mating contact, leading to a break in the electrical connection.

Figure 10A:
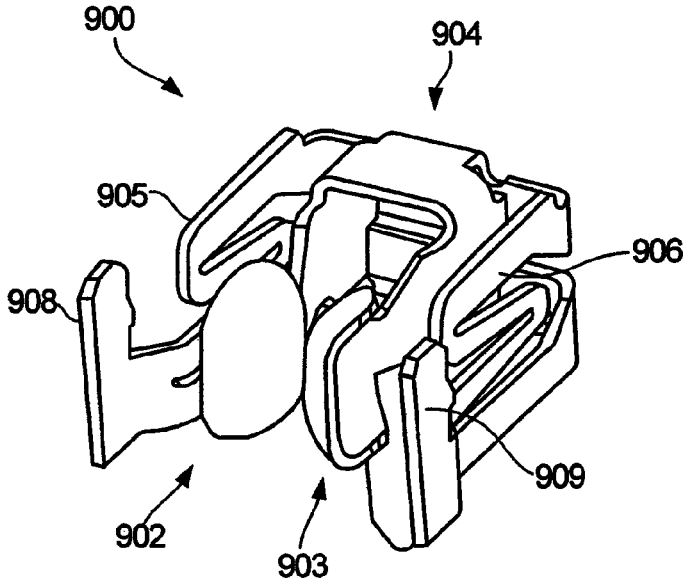
FIG. 10A RELATED ART
FIG. 10A is front perspective view of another known contact.
Figure 10B:
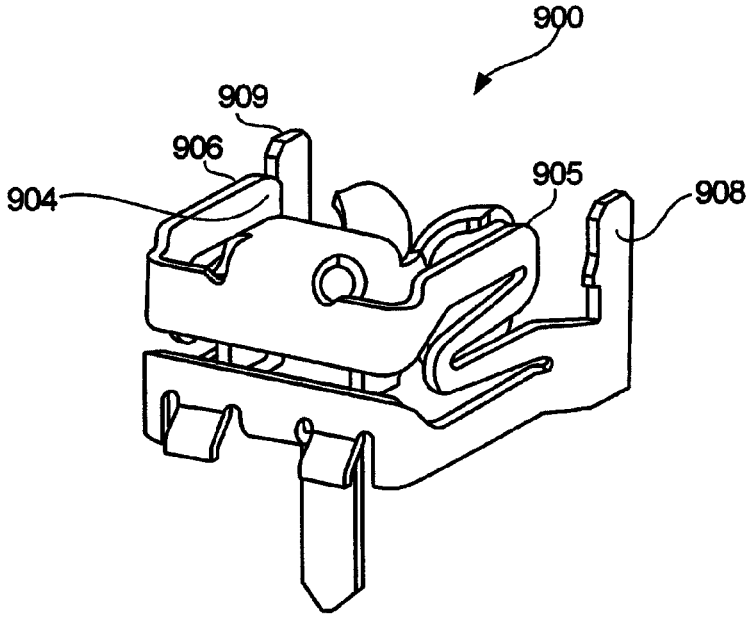
FIG. 10B RELATED ART
FIG. 10B is a rear perspective view of the contact in FIG. 10A.

The contact 1 has a different structure, such that the pair of arms 21 and 22 are generally connected to the support 23 and the pair of springs 5 and 6 are also connected to the support 23. For this reason, the pair of arms 21 and 22 move integrally with the support 23 supported by the springs 5 and 6. Therefore, even when shock is exerted, the condition in which the mating contact is held between the arms 21 and 22 is maintained, and electrical connection is maintained as well. Moreover, the contact 1 has such a structure that the springs 5 and 6 extend in the frontward direction F further than the tabs 3 and 4, then further extend in the backward direction B, and then are connected to the tabs 3 and 4. Therefore, the tabs 3 and 4 are located at positions further in the backward direction B than the connection pads 21*a* and 22*a* provided at the respective tips of the arms 21 and 22. For this reason, interference between the connection pads 21*a* and 22*a* of the arms 21 and 22 and the tabs 3 and 4 is avoided. Thus, as compared with the conventional structure in which tabs are disposed while being aligned with connection pads at the front as shown in FIGS. 10A and 10B, the range in which the arms 21 and 22 may move in the left-right direction LR is large. Further, in the contact 1 according to the invention, the connection pads 21*a* and 22*a* each have a spherical bulge. Therefore, the width in the left-right direction LR from one end to the other end of the tips of the arms 21 and 22 in the state in which the mating contact is interposed therebetween is equal to the thickness of the mating contact plus the respective heights of the bulges of the connection pads 21*a* and 22*a*. To allow the tips of the arms 21 and 22 to move by following the mating contact, it is necessary to ensure the space having a width equal to the sum of the thickness of the mating contact, the respective heights of the bulges of the connection pads 21*a* and 22*a*, and a displacement width of the tips of the arms 21 and 22. In the contact 1 according to the invention, interference between the tabs 3 and 4 and the connection pads 21*a* and 22*a* at the tips of the arms 21 and 22 is avoided and therefore, even though the connection pads 21*a* and 22*a* have the curved surfaces, the space for displacement is ensured sufficiently.

Figure 3:
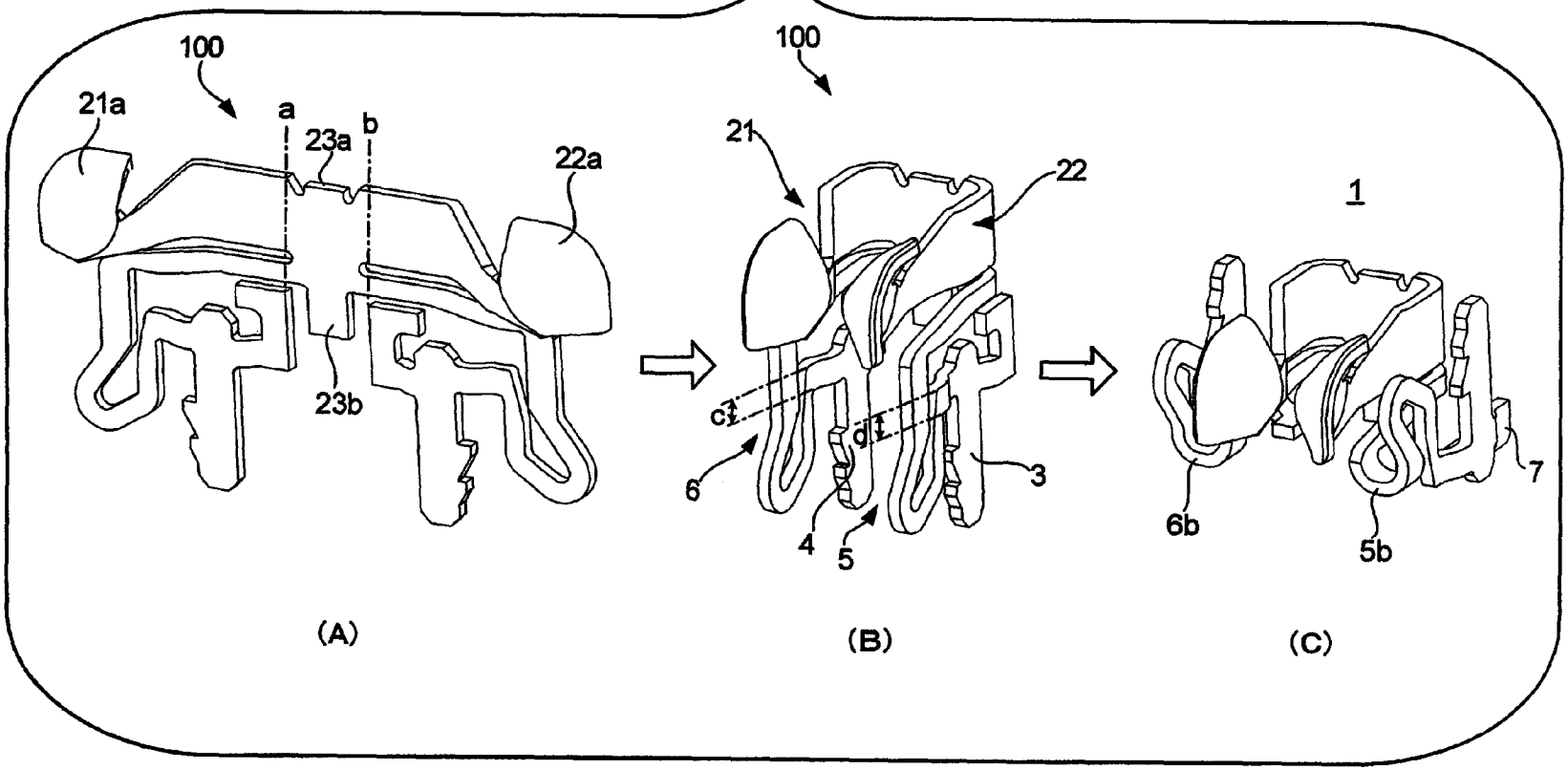
FIG. 3 is a perspective view of several steps in producing the contact of FIG. 1A.

Subsequently, a process of producing the contact 1 will be described, with reference to FIG. 3, which shows the process of producing the contact 1 according to the invention. FIG. 3 illustrates the process of producing the contact from Part (A) to Part (C) sequentially.

The contact 1 is produced by stamping and forming sheet metal. As the sheet metal, for example, a thin sheet having high elasticity such as copper alloy is used. By stamping the sheet metal and bending the connection pads 21*a* and 22*a*, a contact material 100 shown in Part (A) of FIG. 3 is obtained. Incidentally, the contact material 100 is produced such that the metal plate is stamped so that plural contact materials 100 in a state of being linked to a carrier are obtained, each of the plural contact materials 100 are then formed while in the state of being linked to the carrier as shown in Part (A) through Part (C) of FIG. 3, and finally, the plural contact materials 100 are separated from each other. The carrier is omitted in FIG. 3, and only a part corresponding to one contact is shown. Incidentally, connection pieces 23*a* and 23*b* of the contact material shown in Part (A) are portions linked to the carrier and to be removed in the final stage.

First, the contact material 100 is bent 90 degrees along a line a and a line b, so that the arms 21 and 22 and the springs 5 and 6 are formed (see FIG. 3 Part (A)). Further, the respective root parts of the tabs 3 and 4 are bent, accordingly.

Next, the contact material 100 is bent 180 degrees in a range c and a range d, so that the first U-shaped sections 5*b* and 6*b* are formed (Part (B)). Further, as necessary, the substrate connectors 7 and 8 are bent. Incidentally, bent shapes of the second U-shaped sections 5*c* and 6*c* (see FIG. 1) are formed when the metal plate is stamped. In this way, the contact 1 is completed.

Figure 1B:
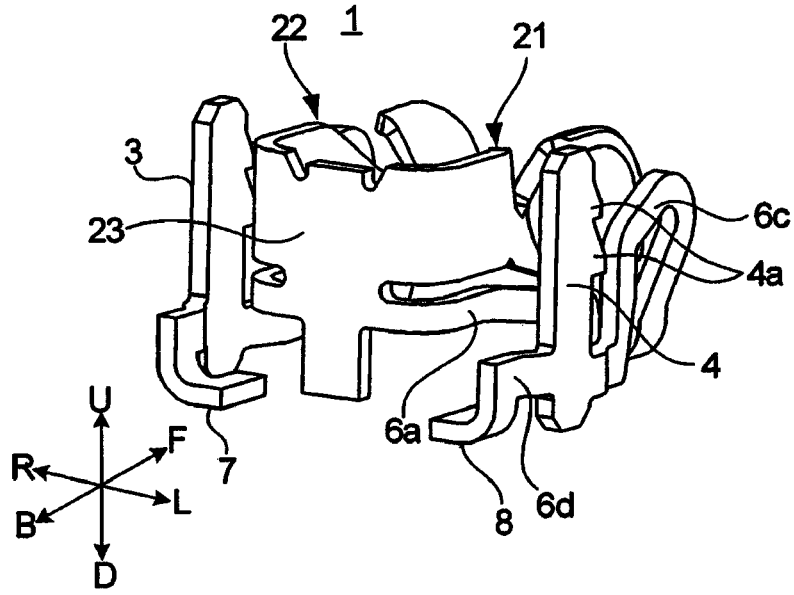
FIG. 1B is another perspective views of the contact in FIG. 1A.
Figure 2A:
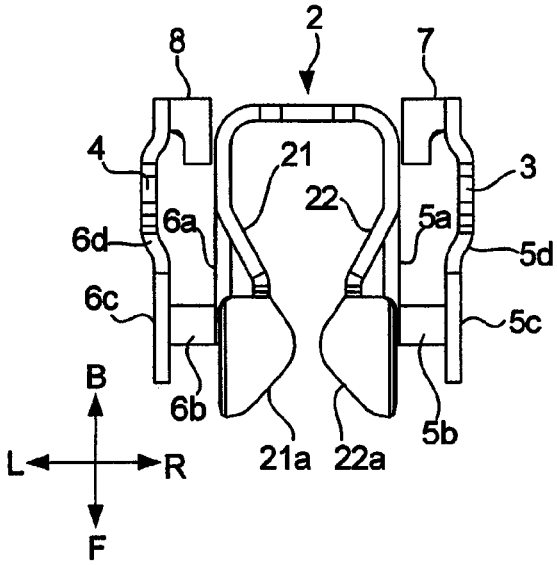
FIG. 2A is a top view of the contact of FIG. 1A.
Figure 2D:
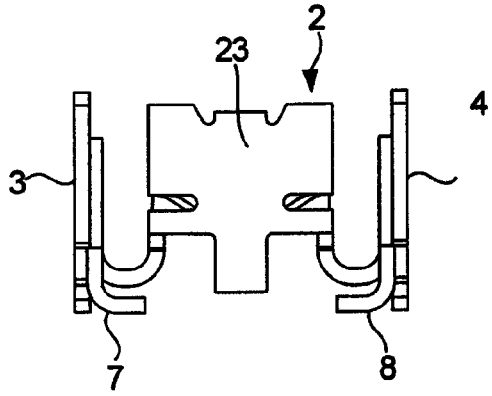
FIG. 2D is a rear view of the contact of FIG. 1A.
Figure 2B:
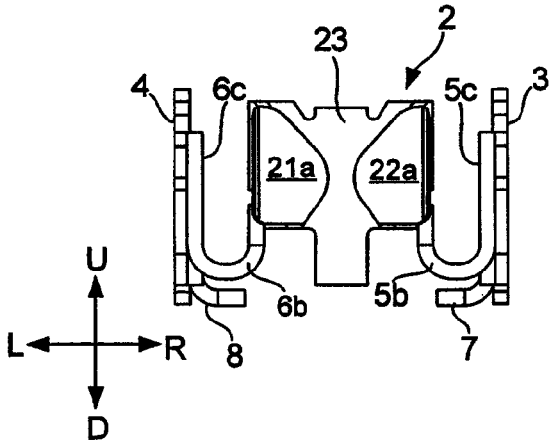
FIG. 2B is a front view of the contact of FIG. 1A.
Figure 2E:
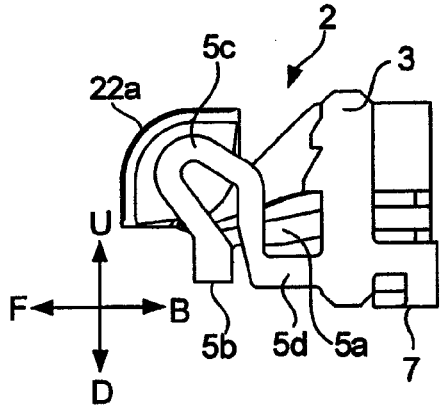
FIG. 2E is a side view of the contact of FIG. 1A.
Figure 2C:
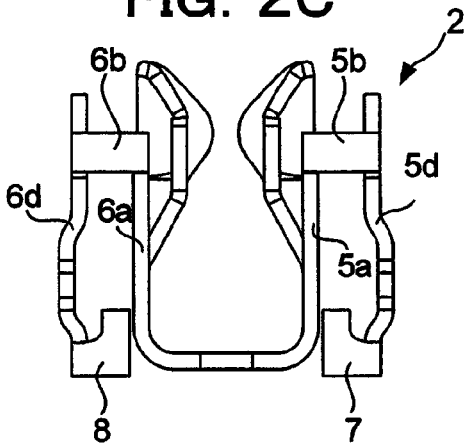
FIG. 2C is a bottom view of the contact of FIG. 1A.

In the contact 1 in FIGS. 1A and 1B, by bending the contact material shown in FIG. 3 into an angle of 90 degrees along each of the line a and the line b, the arms 21 and 22 are obtained that hold the mating contact along both sides in the left-right direction LR, as well as the first extending sections 5*a* and 6*a* extending toward the front of the springs 5 and 6. Further, the shape in which the first U-shaped sections 5*b* and 6*b* are bent outward on the left and right is obtained by bending the contact material 180 degrees in each of the range c and the range d. In this way, bending 180 degrees during the production only once for each of the left side and the right side is sufficient and thus, the contact 1 is easy to produce as compared to the known contact 800 in FIG. 9.

Figure 4A:
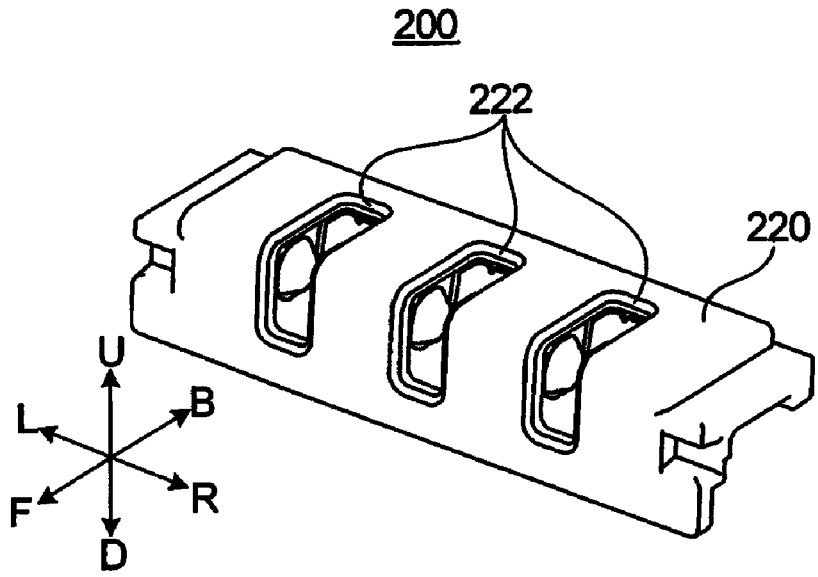
FIG. 4A is a top perspective view of an electrical connector according to the invention.
Figure 4B:
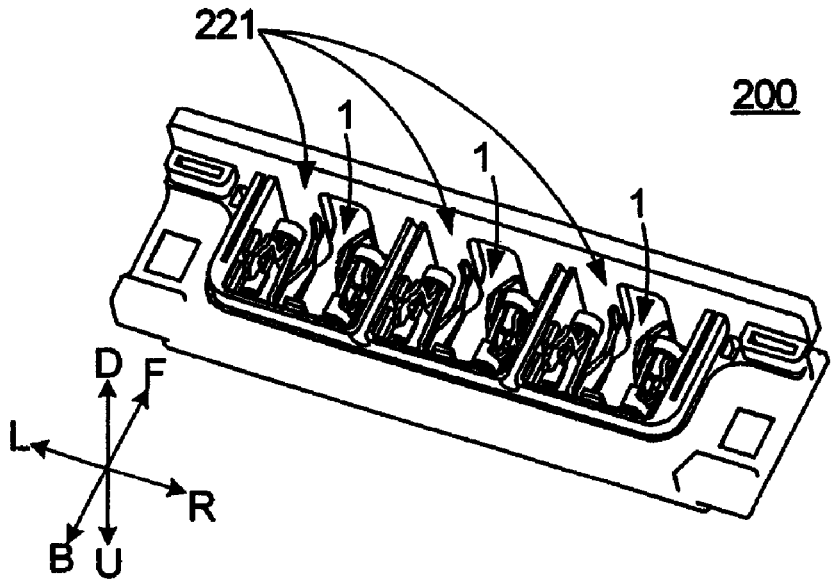
FIG. 4B is bottom perspective view of the electrical connector according to the invention.
Figure 5:
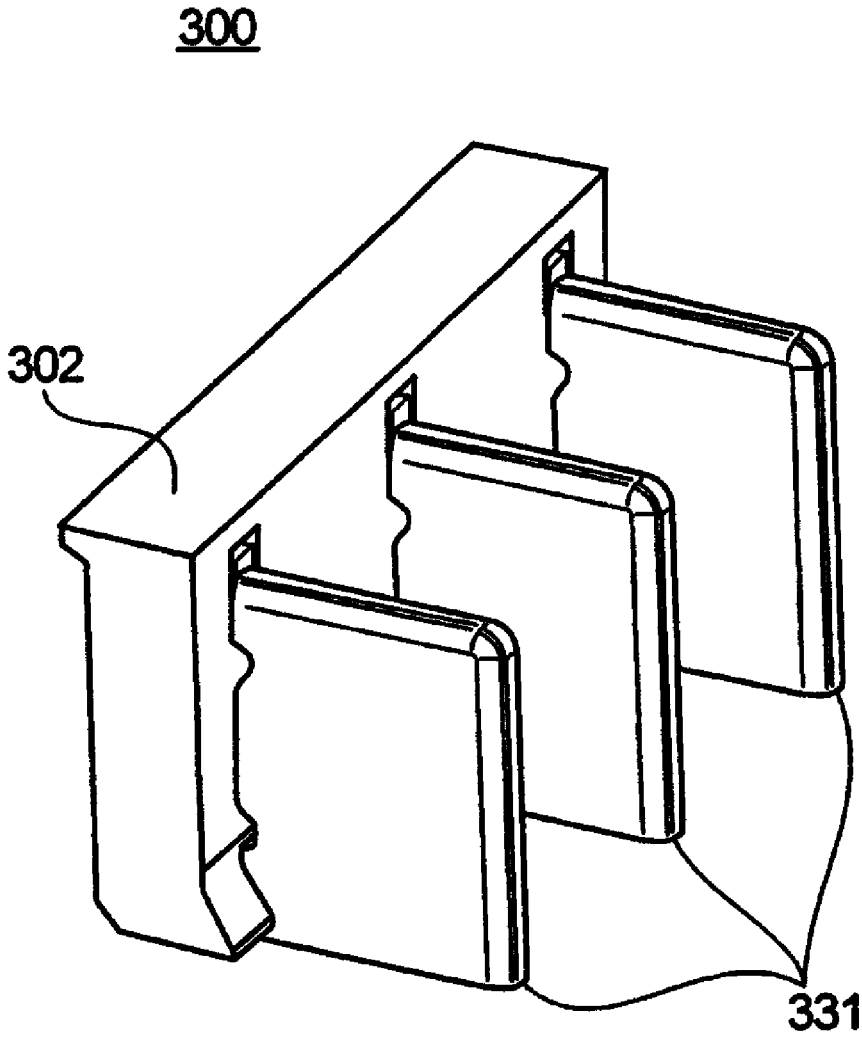
FIG. 5 is a perspective view of a mating connector.

With reference to FIGS. 4A and 4B, external appearances of an electrical connector 200 according to the invention is shown. The connector 200 is a component to which a mating connector 300 in FIG. 5 is to be connected. The connector 200 includes three contacts 1 in the embodiment shown, and a dome-shaped cover 220 that surrounds and protects the contacts 1. For example, the connector 200 is used in a thin battery unit to be mounted inside a cell telephone, and the connector 200 is connected to a circuit board in the thin battery unit by soldering and thereby used as a connector to be coupled to the mating connector (see FIG. 5) provided in the cell telephone. The cover 220 becomes a part of a housing of the battery unit. The cover 220 is equivalent to an example of the connector housing according to the invention. FIG. 4B illustrates a bottom face of the electrical connector in a state in which the circuit board is removed.

Meanwhile, the mating connector 300 in FIG. 5 includes three flat mating contacts 331 disposed substantially in parallel with each other and made of a metallic material, and a fixing member 302 fixing the mating contact 331 and made of an insulating material.

As shown in FIGS. 4A and 4B, in the cover 220, three contact receiving chambers 221 are provided in the embodiment shown, and a window 222 is formed in each of the contact receiving chambers 221. Through the windows 222 of the cover 220, the contacts 331 of the mating connector 300 are electrically connected to the contacts 1, respectively.

Figure 6:
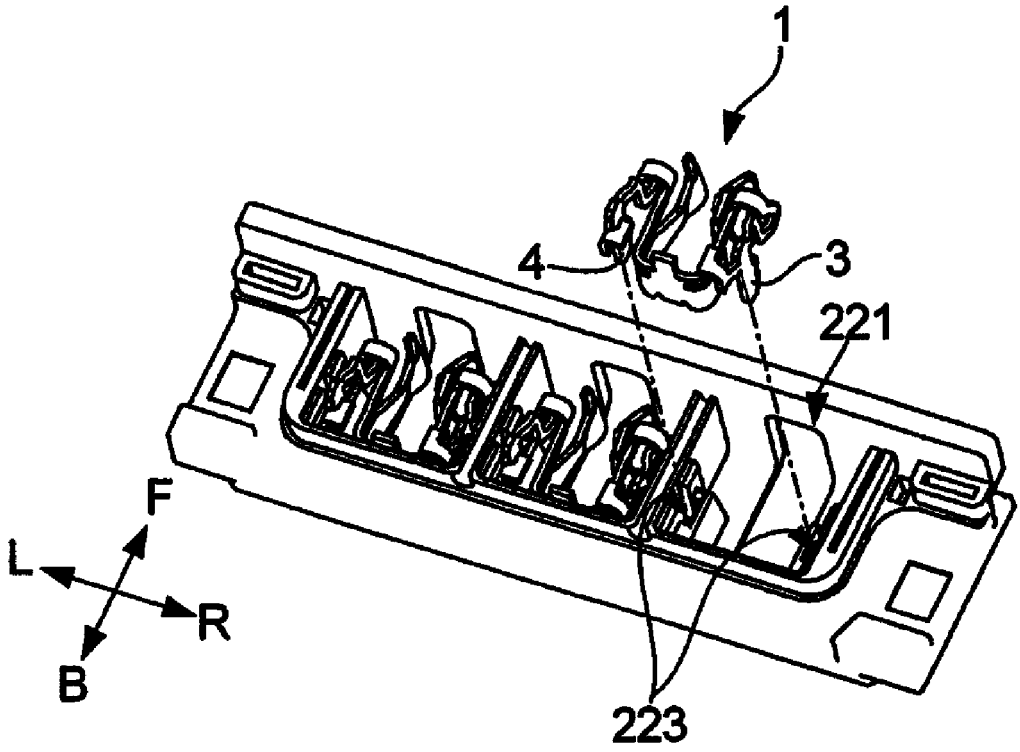
FIG. 6 is an exploded perspective view of the contact of FIG. 1A being attached to a cover according to the invention.
Figure 7:
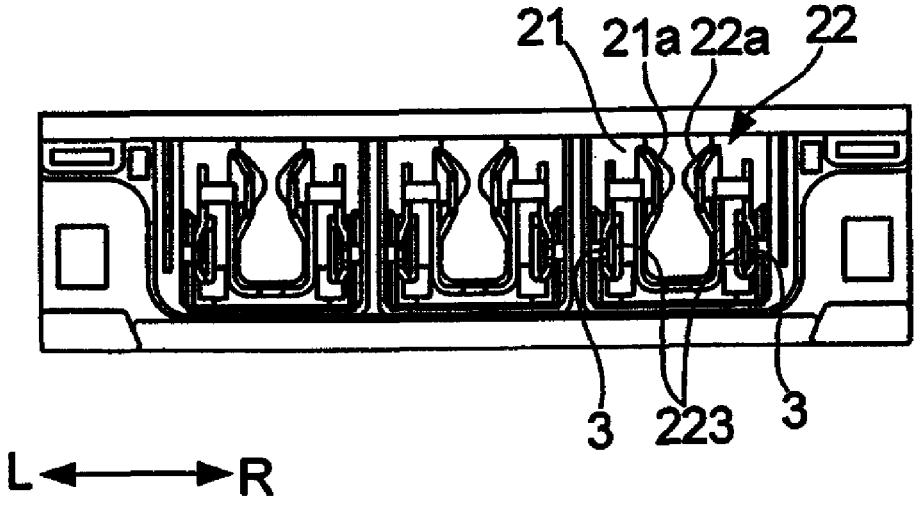
FIG. 7 is a bottom view of the connector according to the invention.

As shown in FIG. 6 and FIG. 7, fixing groove sections 223 are formed at walls that define the contact receiving chamber 221. When the contact 1 is housed in the contact receiving chamber 221, the tabs 3 and 4 are press-fit into the fixing groove sections 223.

As already described above, in the contact 1, the tabs 3 and 4 are located further in the backward direction B than the connection pads 21*a* and 22*a* at the tips of the arms 21 and 22. For this reason, the range in which the arms may move in the left-right direction LR is large, as compared with the known structures in which the tabs are aligned with the connection pads and located at the front. Further, when the range that allows the movement is maintained to the same extent as that of the conventional structure, it is possible to dispose the three contacts 1 in the connector 200 with narrowed spacing, by reducing the space between the pair of press fitted sections. In this case, the size of the connector and the component to which the connector is to be attached may be reduced due to narrowed pitching.

The contact 1 has such a structure that the link sections 5*d* and 6*d* of the spring 5, 6 are connected to the lower ends of the tabs 3 and 4, and the tabs 3 and 4 extend in the upward direction U.

In the electrical connector 200 of the invention, the movements of the arms 21, 22 in the contact 1 are free from restriction by the tabs 3, 4. Therefore, electrical connection is hard to break and besides, the range in which the arms 21, 22 moves is extended, or it is possible to dispose the contacts 1 with a narrow pitch.

In the following description of a contact 400 according to the invention, the same elements as those of the contact 1 described above are provided with the same reference characters as those of the contact 1, and only features different from the contact 1 will be described.

Figure 8:
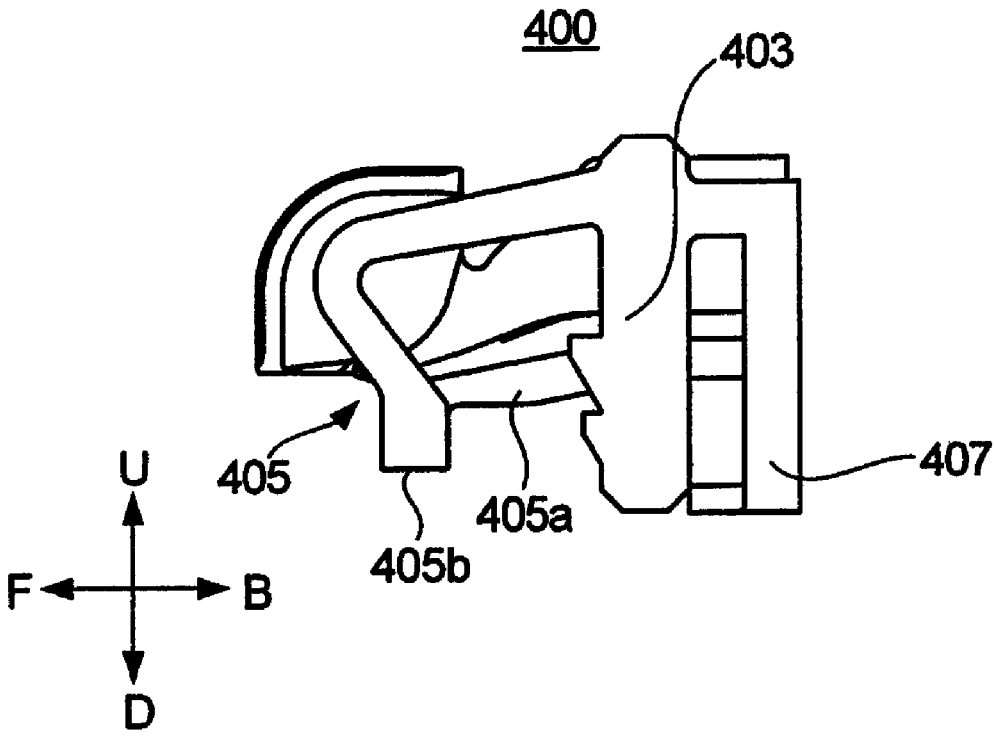
FIG. 8 is a side view of another contact according to the invention.

A contact 400 shown in FIG. 8 is different from the contact 1 in terms of the shapes of its spring, tab and substrate connector. A tab 403 of the contact 400 shown in FIG. 8 extends in the downward direction D, and a spring 405 has a shape of being connected to the upper end of the tab 403. To be more specific, the spring 405 of the contact 400 has such a shape that the spring 405 extends in the upward direction U from a first U-shaped section 405*b* that continues to a first extending section 405*a* and then, after bending, the spring 405 extends in the backward direction B without running along the downward direction D and extends as it is to connect to the tab 403. Incidentally, only the right flank of the contact 400 is shown in FIG. 8. However, the shape of the contact 400 is symmetric and therefore, the shapes of the spring, the tab and the substrate connector on the side opposite to the side shown in FIG. 8 are similar to those shown in FIG. 8.

In the contact 400 shown in FIG. 8 as well, the tab 403 is located further in the backward direction B than the tip of the arm like the contact 1 of the first embodiment and therefore, the range in which the arm may move in the left-right direction is large.

Incidentally, in the contact 1 of the first embodiment, besides the lines a and b and the ranges c and d, the respective root parts of the tabs 3 and 4 and the substrate connectors 7 and 8 also are bent. However, the contact of the present invention is not limited to this example, and the additional bending for the layout of the circuit board and the cover may be omitted. Further, in the second embodiment, the number of the contacts 1 is three, but it may be a number other than three such as four or five.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A contact, comprising: a contact section that includes a pair of arms extending frontward while facing each other and a support bearing the pair of arms; a pair of tabs located on left and right sides of the contact with the contact section positioned between; and a pair of springs that bend from both left and right sides of the support respectively independent of the pair of arms, the pair of springs extending frontward further than the pair of tabs and then extending backward connecting to the pair of tabs;

wherein the pair of springs support the contact section and allow the contact section to move in a left-right direction by elastic deformation.

2. The contact according to claim 1, wherein the tabs extend vertically.

3. The contact according to claim 1, wherein each of the pair of springs includes a first extending section that extends frontward from the support.

4. The contact according to claim 3, wherein each of the pair of springs includes a first U-shaped section that extends from a tip of the first extending section and bends laterally outward to be away from the contact section.

5. The contact according to claim 4, wherein each of the pair of springs includes a second U-shaped section that extends upward from the first U-shaped section and bends rearward and then extends downward.

6. The contact according to claim 5, wherein each of the pair of springs includes a link section that links a downwardly-extending lower end of the second U-shaped section to a lower end of the pair of tabs.

7. The contact according to claim 1, wherein the pair of arms bend at both the left and right sides of the support respectively in positions higher than the pair of springs and extend.

8. The contact according to claim 1, further comprising a pair of connection pads positioned at respective tips of the pair of arms.

9. The contact according to claim 8, the pair of arms are positioned so that a gap between the connection pads is smaller than a thickness of a mating contact.

10. The contact according to claim 8, wherein the connection pads have respective curved surfaces spherically bulging toward each other.

11. The contact according to claim 1, wherein the pair of tabs extend downward and the pair of springs connect to an upper end of the pair of tabs respectively.

12. The contact according to claim 1, wherein the pair of springs extend in an upward direction from a first U-shaped section to a first extending section and then, after bending, the spring extends in a backward direction without running along a downward direction and extends as it is to connect to the tab.

13. An electrical connector comprising: a connector housing to which the contact is attached; and a contact having: a contact section that includes a pair of arms extending frontward while facing each other and a support bearing the pair of arms; a pair of tabs located on left and right sides of contact with the contact section positioned between; and a pair of springs that bend from both left and right sides of the support respectively independent of the pair of arms, the pair of springs extending frontward further than the tabs and then extending backward connecting to the tabs; wherein the pair of springs support the contact section and allow the contact section to move in the left-right direction by elastic deformation.

14. The contact according to claim 13, wherein each of the pair of springs includes a first extending section that extends frontward from the support.

15. The contact according to claim 14, wherein each of the pair of springs includes a first U-shaped section that extends from a tip of the first extending section and bends laterally outward to be away from the contact section.

16. The contact according to claim 15, wherein each of the pair of springs includes a second U-shaped section that extends upward from the first U-shaped section and bends rearward and then extends downward.

17. The contact according to claim 16, wherein each of the pair of springs includes a link section that links a downwardly-extending lower end of the second U-shaped section to a lower end of the pair of tabs.

18. The contact according to claim 12, further comprising a pair of connection pads positioned at respective tips of the pair of arms and positioned so that a gap between the connection pads is smaller than a thickness of a mating contact.

19. The contact according to claim 1, wherein the pair of tabs extend downward and the pair of springs connect to an upper end of the pair of tabs respectively.

20. The contact according to claim 1, wherein the pair of springs extend in an upward direction from a first U-shaped section to a first extending section and then, after bending, the spring extends in a backward direction without running along a downward direction and extends as it is to connect to the tab.

* * * * *